US007353985B1

(12) United States Patent
Weatherholt, II

(10) Patent No.: US 7,353,985 B1
(45) Date of Patent: Apr. 8, 2008

(54) FLEXIBLE AND PROTECTIVE MAILBOX MOUNT

(76) Inventor: Michael J. Weatherholt, II, 4875 Pinespar Tr., Traverse City, MI (US) 49684

( * ) Notice: Subject to any disclaimer, the term of this patent is extended or adjusted under 35 U.S.C. 154(b) by 0 days.

(21) Appl. No.: 11/737,525

(22) Filed: Apr. 19, 2007

Related U.S. Application Data

(60) Provisional application No. 60/793,235, filed on Apr. 20, 2006.

(51) Int. Cl.
*A47G 29/12* (2006.01)

(52) U.S. Cl. ..... 232/39; 248/145; 248/218.4; 248/417; 248/600

(58) Field of Classification Search ..... 232/39, 232/38, 17; 248/145, 417, 418, 218.4, 219.1, 248/599, 600; D99/29–32, 43
See application file for complete search history.

(56) References Cited

U.S. PATENT DOCUMENTS

| | | | | | |
|---|---|---|---|---|---|
| 1,430,476 | A * | 9/1922 | Trekell | 232/39 |
| 2,433,263 | A * | 12/1947 | Conrad et al. | 248/145 |
| 2,550,338 | A * | 4/1951 | Dunagan | 248/145 |
| 4,187,978 | A * | 2/1980 | Dowker | 232/39 |
| 4,735,152 | A * | 4/1988 | Bricker | 108/97 |
| 5,215,283 | A * | 6/1993 | Gould | 248/145 |
| 5,433,376 | A * | 7/1995 | Kueshner | 232/39 |
| 5,460,326 | A * | 10/1995 | Albanesius | 232/39 |
| D365,190 | S * | 12/1995 | Albanesius | D99/43 |
| 5,524,853 | A * | 6/1996 | Varlaro | 248/145 |
| D385,679 | S * | 10/1997 | Sullivan | D99/29 |
| 6,824,113 | B1 * | 11/2004 | Gee et al. | 248/218.4 |
| 6,962,460 | B1 * | 11/2005 | Pratt | 404/6 |
| 7,163,142 | B2 * | 1/2007 | DeLine et al. | 232/39 |
| 2007/0138249 | A1 * | 6/2007 | Webber | 232/39 |

* cited by examiner

*Primary Examiner*—William L. Miller
(74) *Attorney, Agent, or Firm*—Northern Michigan Patent Law, PLC

(57) ABSTRACT

A mailbox mount which includes a heavy-duty spring connecting the mailbox to post via a mounting element. The spring allows the mailbox to return to its initial position after being contacted by another item, such as a snowplow or the like to prevent permanent damage to the mailbox. The mailbox mount also includes a mailbox mounting plate with a protective lip or shield on at least the delivery side of the mailbox.

5 Claims, 2 Drawing Sheets

FLEXIBLE AND PROTECTIVE MAILBOX MOUNT

RELATED APPLICATION

This application is a non-provisional of, and claims priority to, co-pending provisional application No. 60/793,235 by the same inventor, filed Apr. 20, 2006, which is hereby incorporated in its entirety by reference.

TECHNICAL FIELD OF THE INVENTION

The present invention relates to the general art of mailboxes, and to the particular field of mounts for mailboxes.

BACKGROUND OF THE INVENTION

In rural and many suburban areas, mail is delivered to residences and places of business by a delivery person placing the mail into a mailbox positioned at the side of a street or road. Such a mailbox typically includes a box-like housing having a door located on the front of the housing, and the housing is mounted to a post which is secured in the ground. A flag is usually pivotally connected to the mailbox housing, movable between a lowered position and a raised position. The flag can be moved to the raised position to indicate either that a delivery has been made or that items are contained within the box for pickup by the delivery person.

In recent years, many areas have been plagued with considerable damage done to mailboxes, usually as the result of vandalism. Typically, commercially available mailboxes are constructed of lightweight material in an effort to keep costs and prices low. However, such mailboxes are not able to resist damage that can be caused by acts of vandalism. Common forms of such damage include a caved-in box, a bent or twisted door or flag, and removal of the box from the support post.

Heretofore, it has been common practice to permanently and rigidly attach mailboxes to posts and to replace damaged or destroyed rural mailboxes and posts, at considerable inconvenience and/or expense, requiring a new post and a new mailbox and time to assemble and reset the same in the ground.

There are other problems with the use of permanently and rigidly attached mailboxes to posts, most notable being that there is no "give" therewith, upon the application of an outside force, i.e. when the post breaks, e.g. by an errant vehicle, many times it acts as a missile, crashing through windshields and/or striking persons or property in close proximity thereto. And, there are additional problems with the use of permanently and rigidly attached units, most notably being interruption of mail service, upon breakage of the post or mailbox, until repairs and/or replacement are made.

What is needed therefore, is a mailbox design which is better able to withstand acts of vandalism or inadvertent contact by a motor vehicle without suffering damage that requires replacement of the mailbox.

SUMMARY OF THE INVENTION

These, and other, objects are achieved by a mailbox mount which includes a heavy-duty spring connecting the mailbox to post via a mounting element. The spring allows the mailbox to return to its initial position after being contacted by another item, such as a snowplow or the like to prevent permanent damage to the mailbox.

In a further form, the invention is a spring-mounted mailbox support plate with an integral protective lip or shield on at least a delivery side of the mailbox.

DETAILED DESCRIPTION OF THE PREFERRED EMBODIMENT OF THE INVENTION

Figure 1:
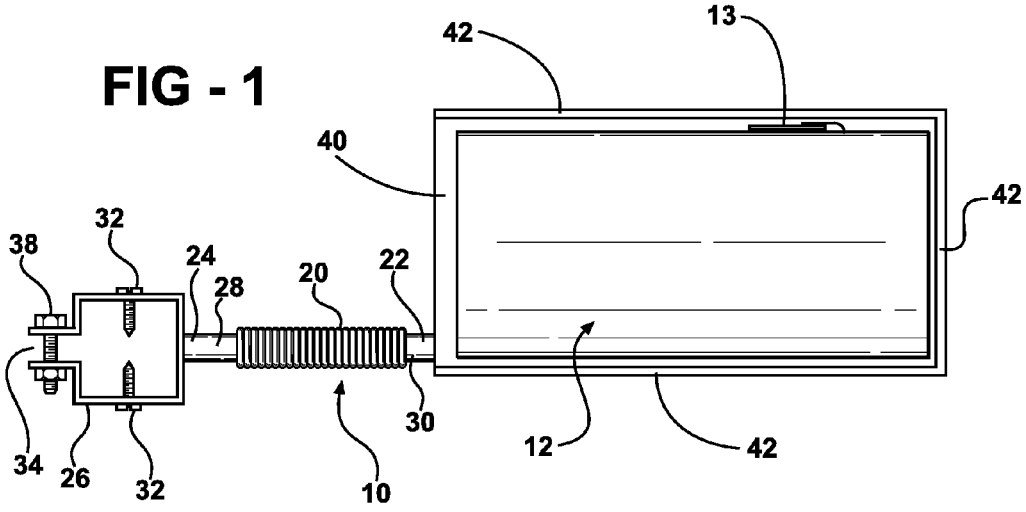
FIG. 1 is a top plan view of a mailbox system embodying the present invention.

Other objects, features and advantages of the invention will become apparent from a consideration of the following detailed description and the accompanying drawings. Referring to the figures, it can be understood that the present invention is embodied in a support system 10 for attaching a mailbox 12 to a support, such as a post 14 in a manner which permits movement of the mailbox with respect to the support without permanently damaging the mailbox or its support system.

Support system 10 includes a heavy duty spring 20 having one end 22 fixed to the mailbox and a second end 24 fixed to a bracket 26 by elements 28 and 30. Spring 20 can be any suitable heavy duty spring.

Bracket 26 includes fasteners, such as screws 32, for attaching the bracket to support 14, and a tightening ear unit 34 which includes a fastening bolt 38. If the mailbox is contacted by a vehicle, such as a snowplow, the mailbox will simply give and swing back and forth on the post due to the resiliency of the spring and will not be damaged.

A steel mounting plate 40 can be used to further support mailbox 12. Mounting plate 40 includes a lip 42 which surrounds the mailbox to further protect the mailbox from damage. Mailbox 12 is fixed to the mounting plate 40 by known means such as welding or with bolts. It will be understood that materials other than steel can be used for the mounting plate.

Figure 2:
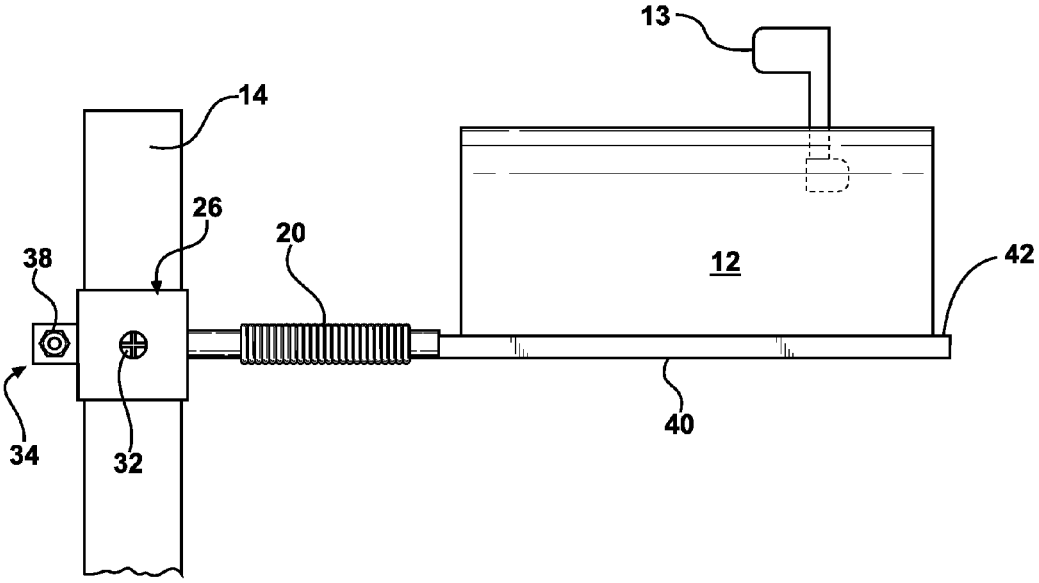
FIG. 2 is a side elevational view of the mailbox shown in FIG. 1.
Figure 3:
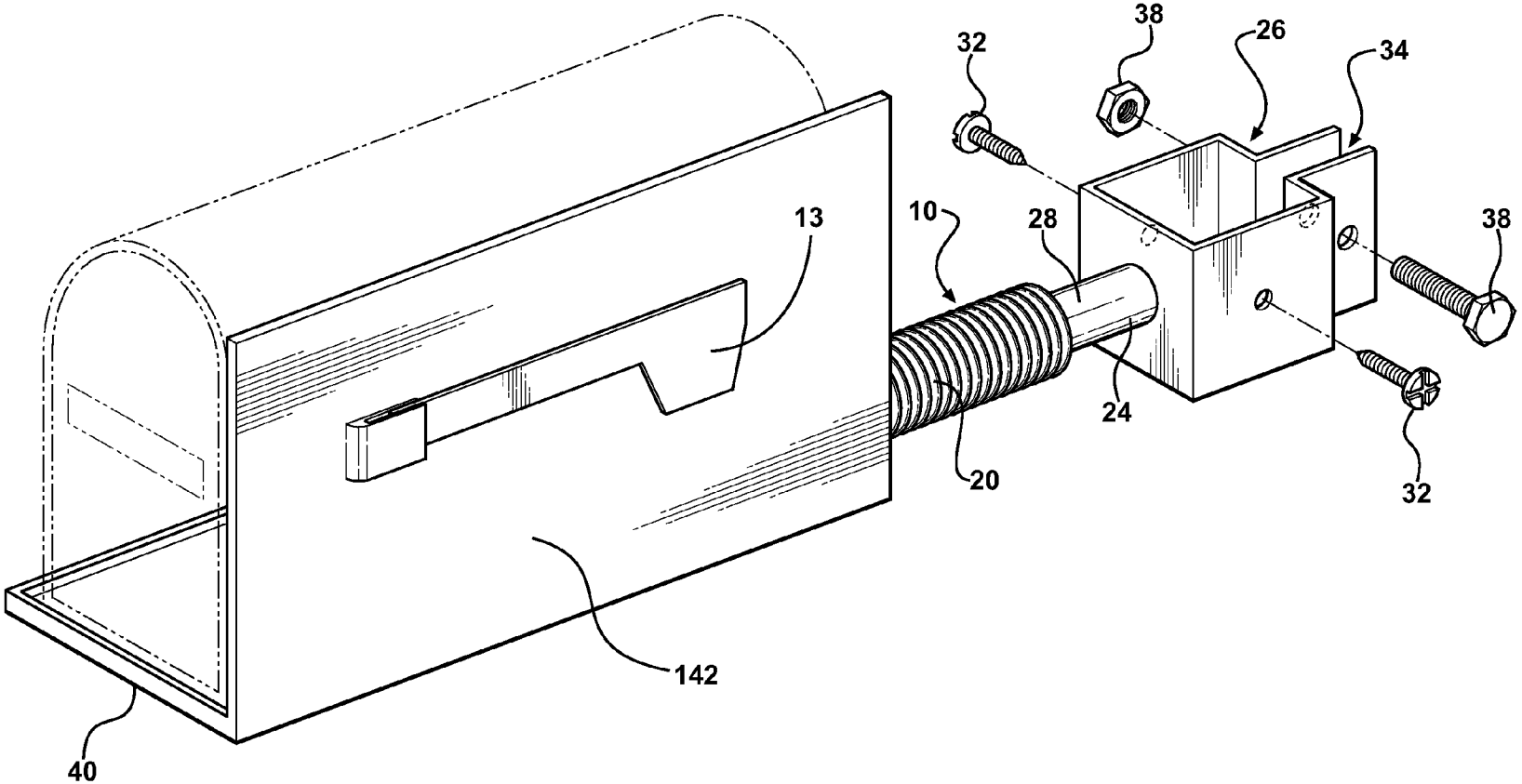
FIG. 3 is a front perspective view of the mailbox shown in FIG. 1, but with the protective lip or shield enlarged on the delivery side of the mailbox.

While FIGS. 1 and 2 show lip 42 as a low lip surrounding both the sides and front of mailbox 12, FIG. 3 shows an alternate embodiment in which lip 42 is extended in height on the delivery side of the mailbox as shield 142 (the side approached by the delivery truck and approaching traffic) to effectively shield the entire delivery side of mailbox 12, which is spaced from the lip and shield as best shown in the plan view of FIG. 1. Lip 42 and/or the extended shield portion 142 are preferably integrally formed with the steel mounting plate 40. As illustrated in FIG. 3, shield portion 142 can be provided with a mounting hole to movably mount flag 13 (normally mounted on mailbox 12) so that access to the flag is not obstructed by shield portion 142. FIG. 3 also shows heavy duty coil spring 20 having a centered connection to the mounting plate 40.

It is understood that while certain forms of the present invention have been illustrated and described herein, it is not to be limited to the specific forms or arrangements of parts described and shown.

What is claimed is:

1. A mailbox protection system comprising:

A) a mailbox;

B) a support post associated with the mailbox;

C) a bracket element fixed to the support post;

D) a mounting plate fixedly attached to and supporting an underside of the mailbox, the mounting plate including a vertical lip raised in front of and spaced from a delivery side of the mailbox;

E) a heavy duty spring having a first end fixed to the mounting plate and a second end fixed to the bracket to flexibly support and space the mounting plate and mailbox from the support post.

2. The mailbox system defined in claim 1 wherein the vertical lip surrounds the delivery side, a front side, and another side of the mailbox.

3. The mailbox system of claim 1 wherein the vertical lip shields the entire delivery side of the mailbox.

4. The mailbox system defined in claim 1 wherein the mailbox support comprises a vertical post, and further including a tightening ear unit on the bracket for securing the bracket to the vertical post, the tightening ear unit including a fastening bolt.

5. A mailbox protection system comprising a horizontal mailbox mounting plate for securely mounting and supporting an underside of a mailbox, the mounting plate having a rear portion spaced behind a rear side of the mailbox mounted thereon, a heavy duty coil spring connected to and extending horizontally from the rear portion of the mounting plate to a mailbox support, and a raised shield extending from a delivery side of the mounting plate to shield a delivery side of the mailbox mounted thereon the spring spacing the mounting plate and the mailbox from the support.

* * * * *